US006318726B1

(12) United States Patent
Nicholls

(10) Patent No.: US 6,318,726 B1
(45) Date of Patent: Nov. 20, 2001

(54) PIVOTING BOARD GAME

(76) Inventor: Paul Kenneth Nicholls, 6 Church St. Apt. 3, St. Catharines, Ontario (CA), L2R 3B2

( * ) Notice: Subject to any disclaimer, the term of this patent is extended or adjusted under 35 U.S.C. 154(b) by 0 days.

(21) Appl. No.: 09/693,940

(22) Filed: Oct. 23, 2000

Related U.S. Application Data

(60) Provisional application No. 60/160,886, filed on Oct. 22, 1999.

(51) Int. Cl.[7] ..... A63F 3/00
(52) U.S. Cl. ..... 273/450; 273/449
(58) Field of Search ..... 273/440, 449, 273/450, 459, 287

(56) References Cited

U.S. PATENT DOCUMENTS 3,567,221 * 3/1971 Stults ..... 273/459
3,675,920 * 7/1972 Gorman ..... 273/459
3,744,792 * 7/1973 McClary et al. ..... 273/459
4,579,346 * 4/1986 Giuntoli ..... 273/449 X
4,589,664 * 5/1986 Slimp, Jr. ..... 273/449 X
5,240,260 * 8/1993 Strongin ..... 273/450 X

FOREIGN PATENT DOCUMENTS

1122375 * 9/1956 (FR) ..... 273/450
1046315 * 10/1966 (GB) ..... 273/449

* cited by examiner

*Primary Examiner*—Raleigh W. Chiu
(74) *Attorney, Agent, or Firm*—Patrick J. Hofbauer

(57) ABSTRACT

A game apparatus, comprising a body, having a rotational axis and a non-planar surface, and a support, is disclosed. The support supports the body in a starting position, whereat the axis is horizontal, a center of gravity of the body is below the axis and the surface presents upwardly, and enables the body to rotate about the axis through a range of rotation. Playing pieces are provided. The surface includes playing positions, a socket being provided at each playing position, for releasably retaining selected ones of the playing pieces in fixed position relative to the surface upon selective distribution of said selected ones of the playing pieces to respective ones of the playing positions. The body is adapted for variable pivotal displacement about the axis relative to the starting position by effect of gravity responsive to said selective distribution. A scale for measuring said variable pivotal displacement is also provided.

26 Claims, 10 Drawing Sheets

PIVOTING BOARD GAME

This application claims the benefit of U.S. Provisional Patent Application Serial No. 60/160,886 filed on Oct. 22, 1999.

FIELD OF THE INVENTION

The present invention relates to games of skill and memory, and more particularly, to a pivoting board game apparatus and a method of play developed therefor.

BACKGROUND OF THE INVENTION

Balancing games, of the general type wherein the players thereof each seek to ensure that an equilibrium configuration of a collection of items becomes unstable at the hand of players adverse in interest, have long been known.

An example of a game of this general type is shown in U.S. Pat. No. 4,932,655 (Kurita), which relates to a BALANCING GAME. In the game described in the Kurita patent, an elastic support is provided. The elastic support has an upper horizontal support plate. A plurality of weight pieces are also provided, which are equally distributed amongst players at the start of a game. During a typical play scenario, the weight pieces are placed upon the upper support one-by-one in rotating turns by the players. The support tends to be more easily unbalanced and spill pieces with the increasing weight of the pieces. A player whose last-played piece causes a spill must take possession of the spilled pieces. The first player who exhausts his or her supply of pieces is the victor.

The readily perceptible tilting action of the balancing game described in the Kurita patent provides for great interest in play. However, this game has limited appeal to parents who would prefer that the competitive instincts of their children be manifest in individual self-achievement, rather than, as is the objective of this game, in the promotion of the failure of others. Further, this game suffers in that it does not reward the memory of players, and as such, has limited appeal to parents who would prefer that their children play games which exercise their memory skills. Further, this game suffers, in that it is easily mastered such that, as between experienced players, victory is usually a matter of chance. Accordingly, the game has limited appeal to persons other than children. Given that a significant proportion of game purchases relate to purchases made by adults for their own use, or by parents, for their children, all of the foregoing significantly detracts from the public acceptance of this game, despite the aforementioned great interest in play resultant from the tilting action.

SUMMARY OF THE INVENTION

It is an object of the present invention to overcome, inter alia, the shortcomings of the prior art described above by providing a balancing game wherein tilting action is readily perceptible; which rewards players for self-achievement; which rewards the memory of players; and which is not easily mastered.

These and other objects are addressed by the present invention, a game apparatus and method of play therefor.

The game apparatus comprises a body member, having a first axis and a non-planar playing surface, and a support means. The support means supports the body member in a starting position thereof, whereat the first axis is substantially horizontal and the non-planar playing surface presents substantially upwardly. The support means additionally enables the body member to rotate freely about the first axis, the body member being weighted, shaped and dimensioned such that, when said body member is at the starting position thereof, a center of gravity of said body member is positioned substantially below said first axis.

According to one aspect of the invention, the non-planar playing surface preferably has defined thereon a first plurality of demarcated playing positions.

According to another aspect of the invention, the game apparatus preferably further comprises a second plurality of playing pieces.

According to another aspect of the invention, the support means preferably enables said body member to rotate freely about said first axis through a first selected range of rotation.

According to another aspect of the invention, a retention means is preferably provided for retaining selected ones of the second plurality of playing pieces in fixed position relative to the non-planar playing surface upon selective distribution of said selected ones of the second plurality of playing pieces at respective ones of the first plurality of demarcated playing positions.

According to another aspect of the invention, the body member is preferably adapted for variable pivotal displacement about said first axis relative to said starting position by effect of gravity responsive to said selective distribution of said selected ones of said second plurality of playing pieces at said respective ones of said first plurality of demarcated playing positions.

According to yet another aspect of the invention, the game apparatus preferably further comprises a measurement means for measuring said variable pivotal displacement of the body member.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the game apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
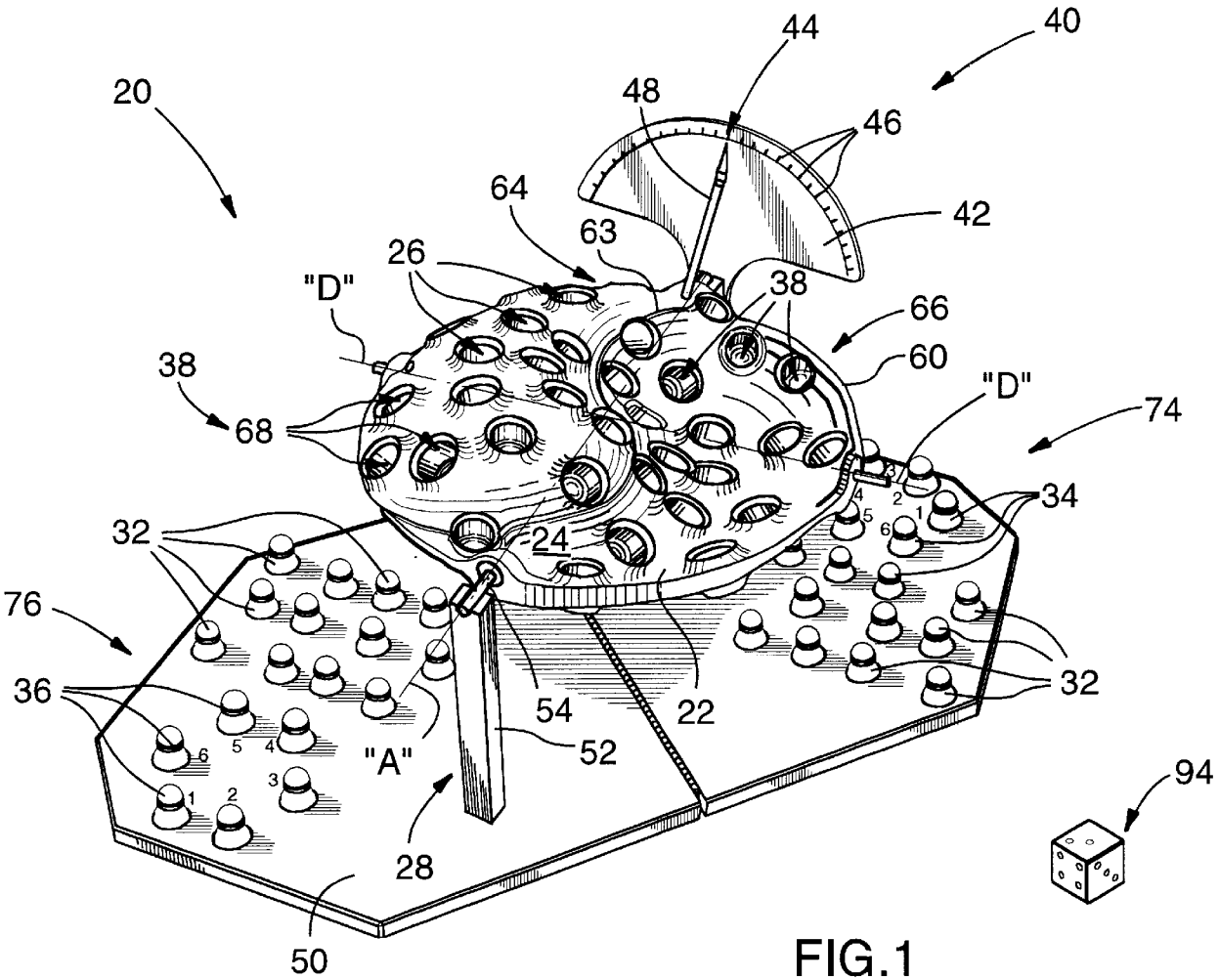
FIG. 1 is a perspective view of a game apparatus according to a preferred embodiment of the present invention, shown with the body member at its starting position.

Referring now to FIGS. 1 through 12 of the drawings, there is shown a preferred embodiment of a game apparatus of the present invention, as designated by the general reference numeral 20.

Figure 4:
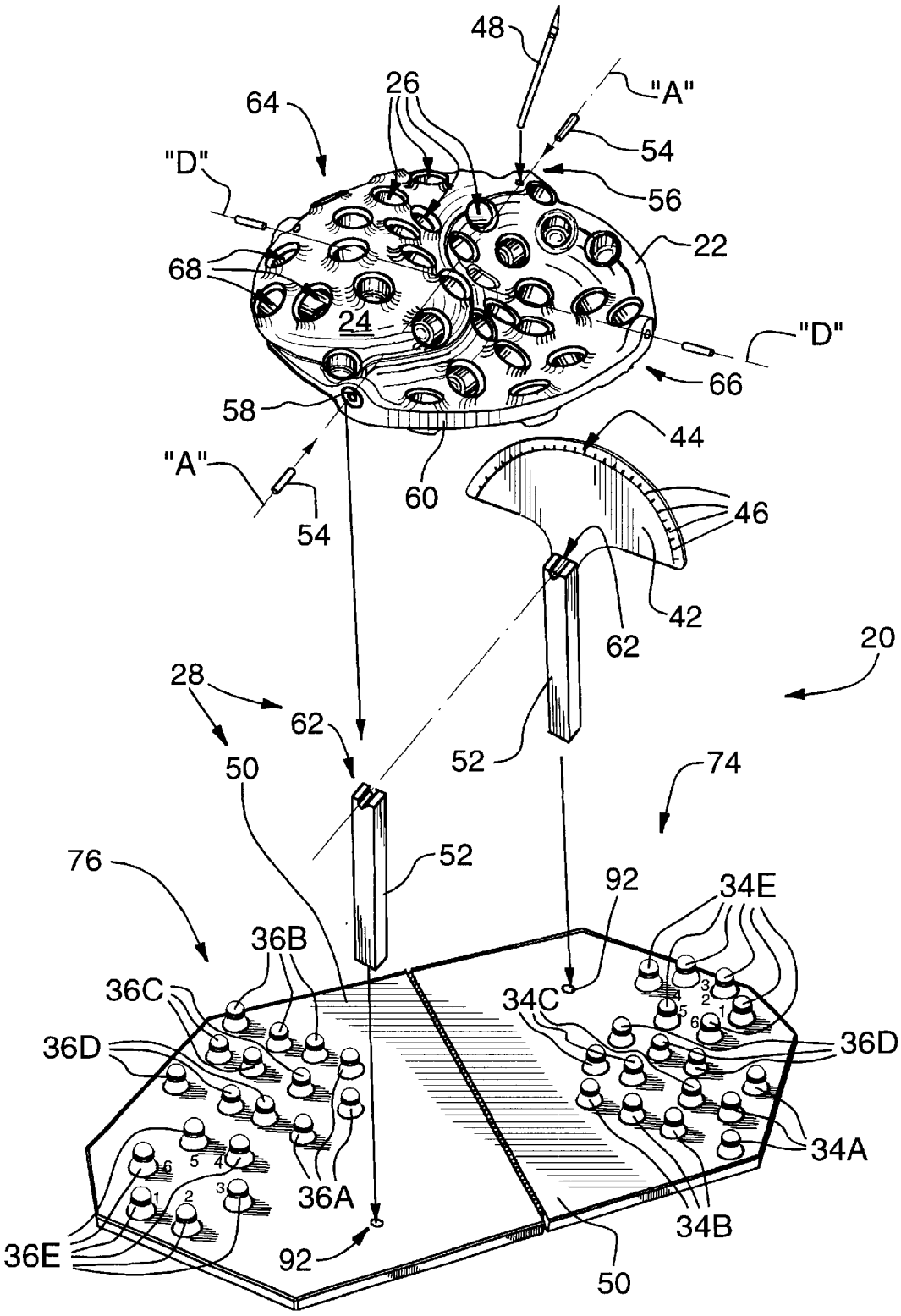
FIG. 4 is an exploded perspective view of the game apparatus of FIG. 1.

As can best be seen in FIGS. 1 and 4, the game apparatus of the preferred embodiment of the present invention comprises a body member 22 having a first axis "A", a non-planar playing surface 24 and a continuous peripheral edge 60. The non-planar playing surface 24 has defined thereon a first plurality of demarcated playing positions 26, totaling thirty-six in number, the purpose of which will become evident upon further review of the following description.

Also shown in FIG. 4 is a support means, designated by the general reference numeral 28. The support means 28 is adapted to support the body member 22 in a starting position thereof, shown in FIGS. 1 and 8, whereat the first axis "A" is substantially horizontal, a center of gravity 30 of the body member 22 is positioned substantially below the first axis "A" and the non-planar playing surface 24 presents substantially upwardly.

Figure 8:
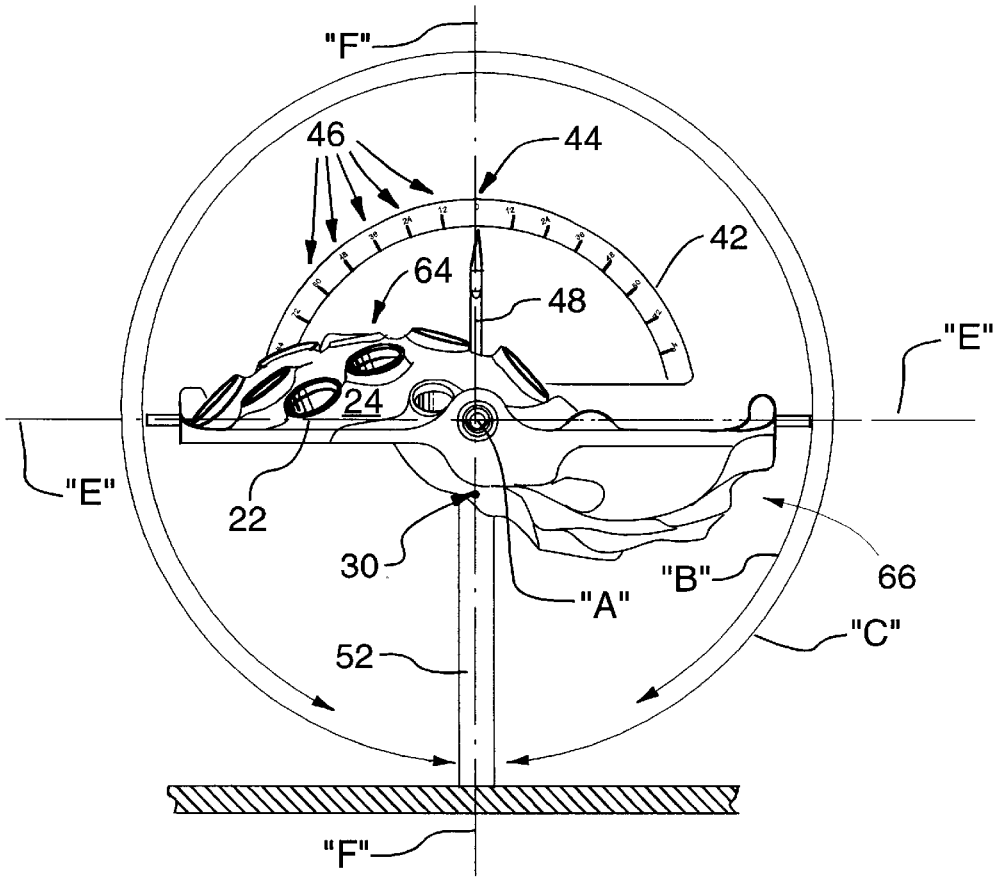
FIG. 8 is a partial sectional view of the game apparatus of FIG. 1, along sight line 8—8 of FIG. 7.
Figure 9:
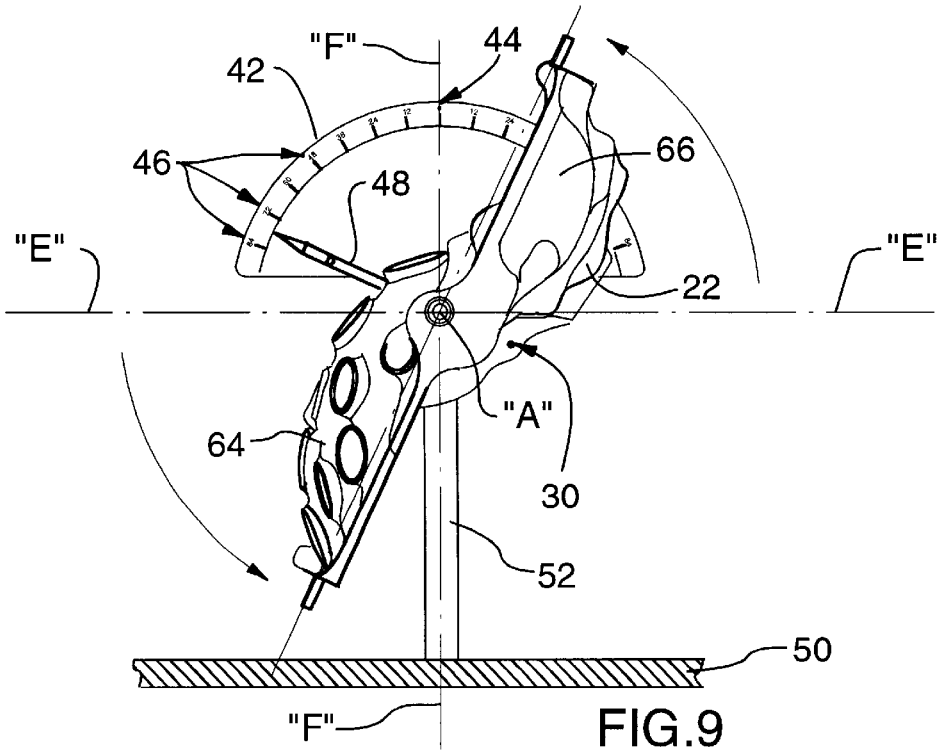
FIG. 9 is a view similar to FIG. 8, with the body member pivotally displaced counter-clockwise relative to its starting position.
Figure 10:
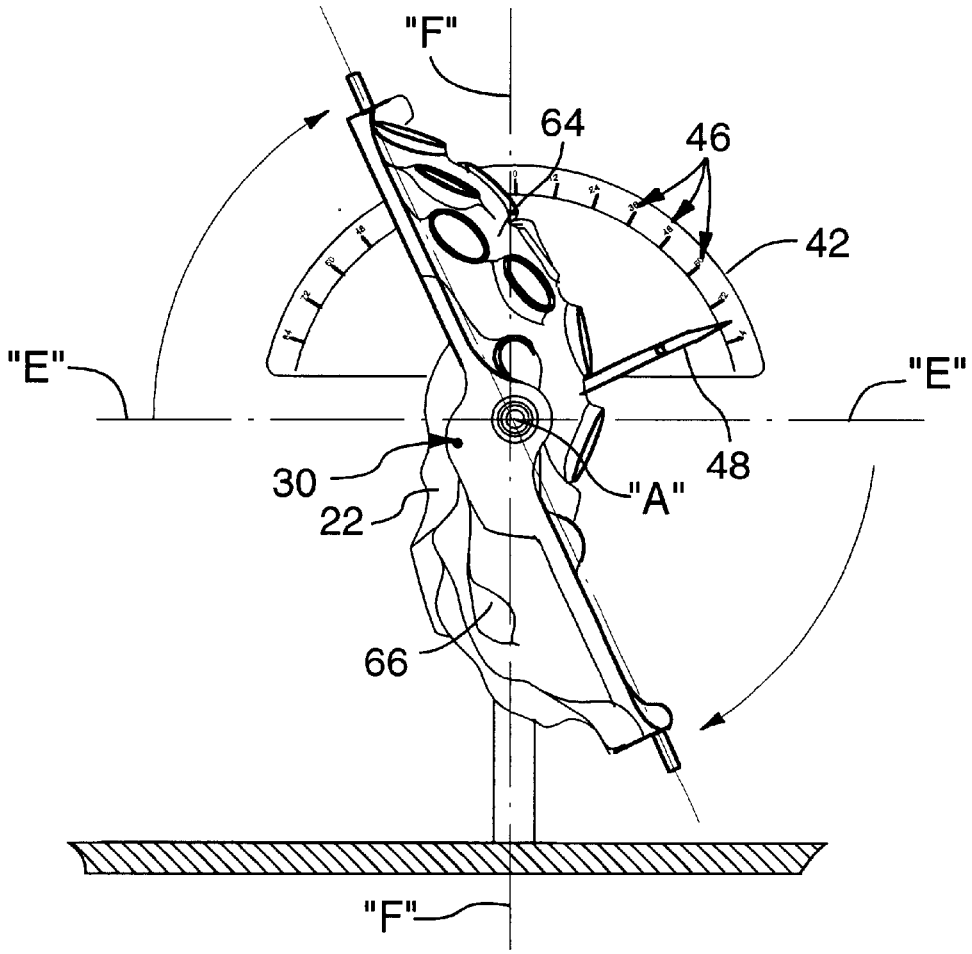
FIG. 10 is a view similar to FIG. 8, with the body member pivotally displaced clockwise relative to its starting position.
Figure 11:
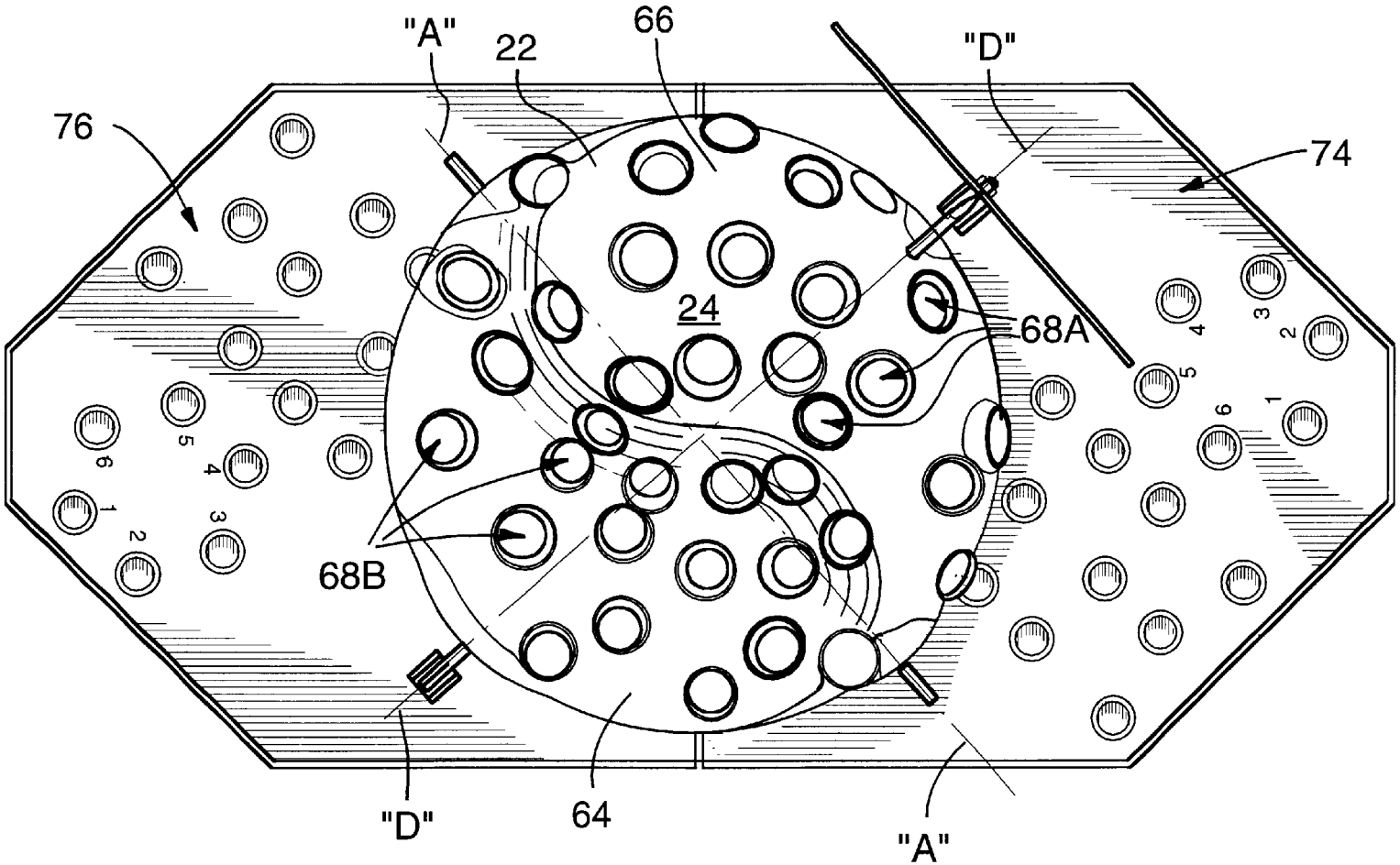
FIG. 11 is a view similar to FIG. 7, with the body member positioned at an alternate starting position.

As well, the support means 28 is adapted to enable the body member 22 to rotate freely about the first axis "A" through a first selected range of rotation and also through a second selected range of rotation containing the first selected range of rotation, said first selected range and said second selected range being depicted in FIG. 8 by arcs "B" and "C" respectively.

Figure 3:
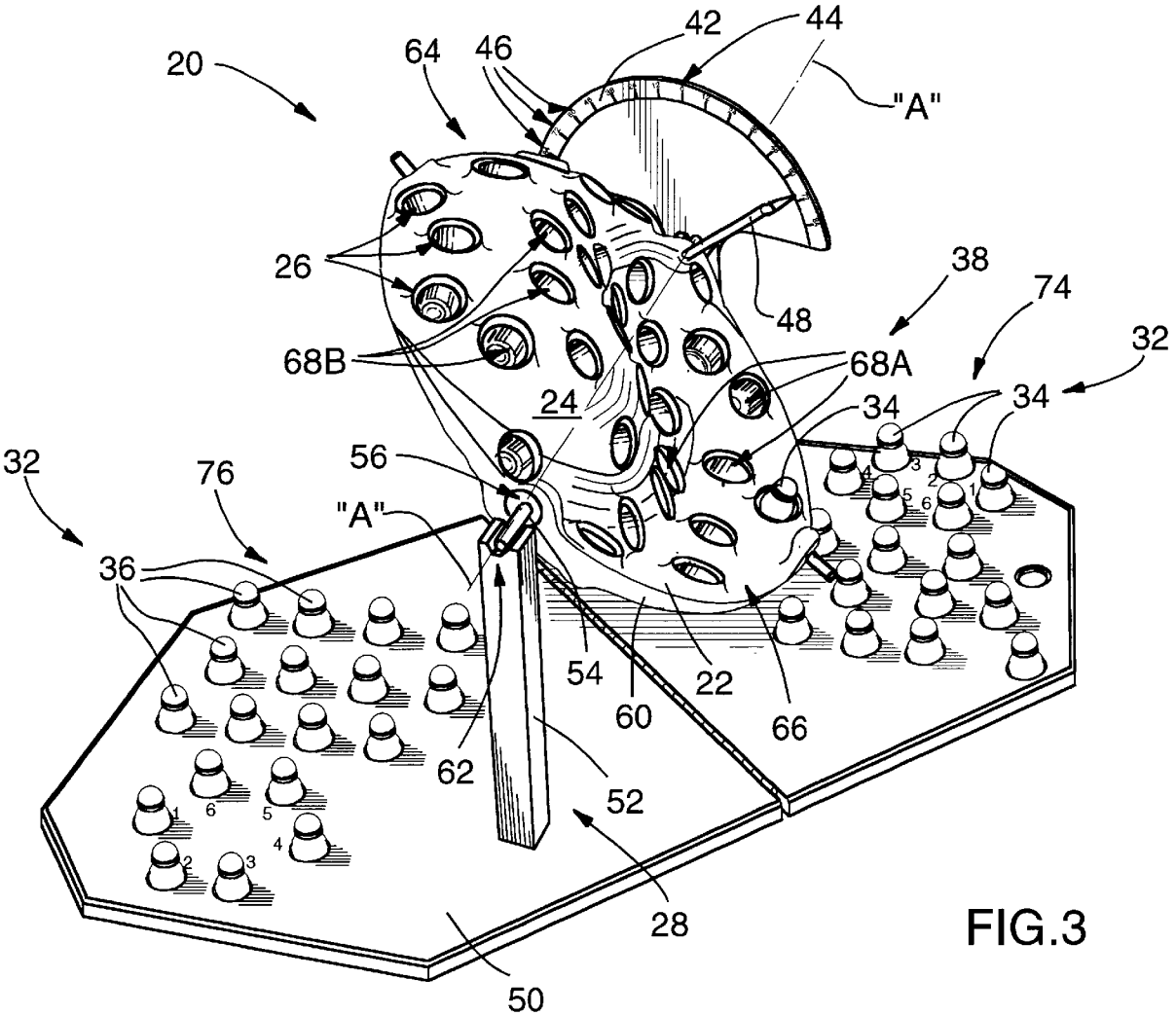
FIG. 3 is a view similar to FIG. 2, with the respective one of the Yin stones positioned within the respective one of the Yin sockets and the body member pivotally displaced relative to its starting position.

Also provided is a second plurality of playing pieces 32, totaling thirty-six in number. As best seen in FIGS. 3 and 4, the playing pieces 32 comprise Yin stones 34 and Yang stones 36, grouped as follows: three light weight Yang stones 36A each having a mass of approximately 6 grams; three medium light weight Yang stones 36B each having a mass of approximately 12 grams; three medium heavy weight Yang stones 36C each having a mass of approximately 18 grams; three heavy weight Yang stones 36D each having a mass of approximately 24 grams; six mystery weight Yang stones 36E having respective masses of approximately 5, 10, 15, 30, 40 and 50 grams; three light weight Yin stones 34A each having a mass of approximately 6 grams; three medium light weight Yin stones 34B each having a mass of approximately 12 grams; three medium heavy weight Yin stones 34C each having a mass of 18 grams; three heavy weight Yin stones 34D each having a mass of 24 grams; and six mystery weight Yin stones 34E having respective masses of approximately 5, 10, 15, 30, 40 and 50 grams.

The Yin stones 34 and Yang stones 36 are respectively coloured or otherwise marked in accordance with their grouping, for identification as between one another, and are all approximately 1" in diameter.

Figure 2:
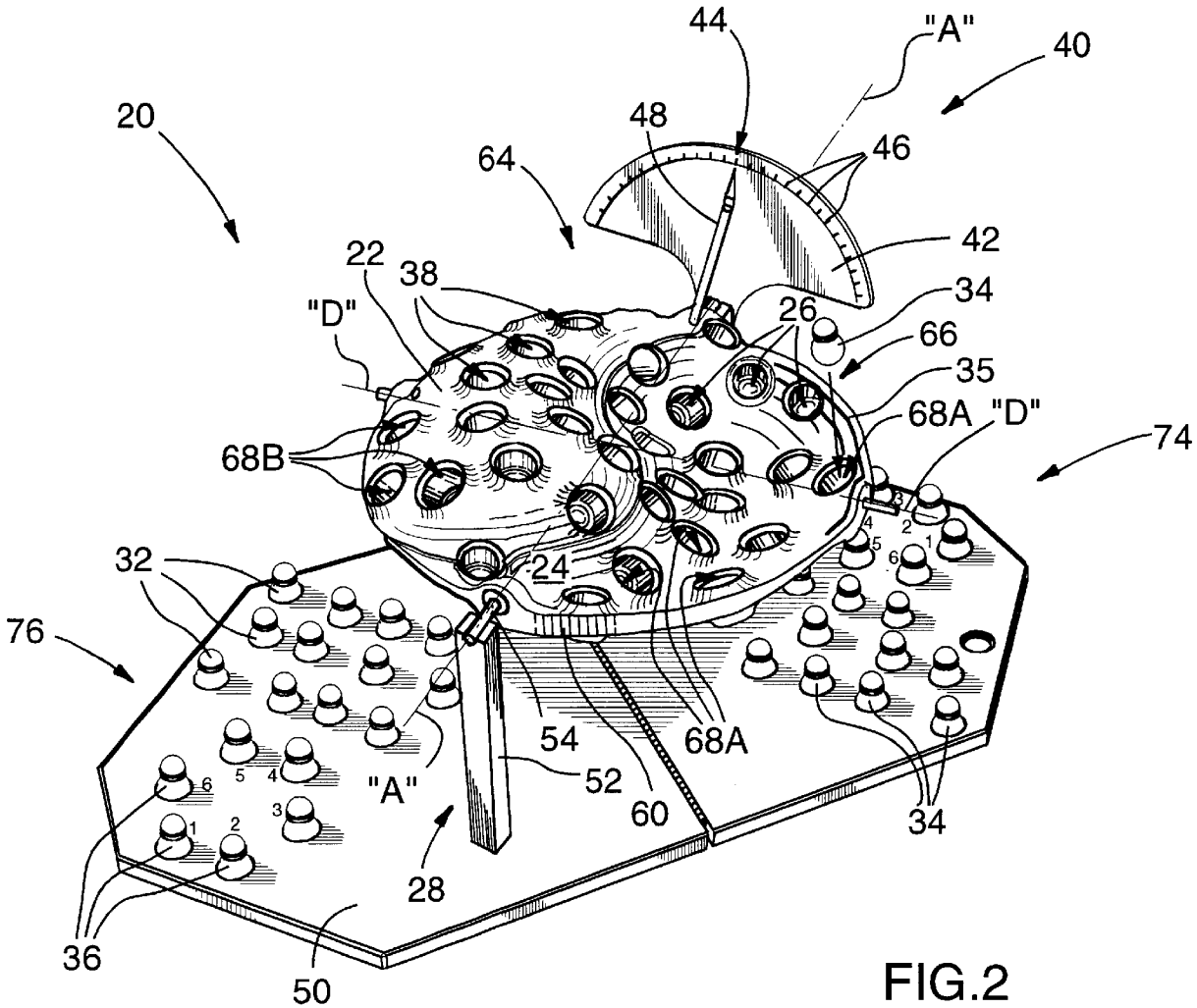
FIG. 2 is a view similar to FIG. 1, with a respective one of the Yin stones positioned adjacent to a respective one of the Yin sockets, for subsequent placement therewithin.

The body member 22 is adapted for variable pivotal displacement about the first axis "A" relative to the starting position by effect of gravity responsive to the selective distribution of selected ones of the second plurality of playing pieces 32 at respective ones of the first plurality of demarcated playing positions 26. A retention means, designated by the general reference numeral 38 in FIG. 2, is provided for releasably retaining said selected ones of the second plurality of playing pieces 32 in fixed position relative to said non-planar playing surface 24 upon said selective distribution of said selected ones of said second plurality of playing pieces 32 at said respective ones of said first plurality of demarcated playing positions 26 when said body member 22 is positioned within the first selected range of rotation "B". The retention means 38 is described more fully in subsequent paragraphs.

In the preferred embodiment illustrated, the second selected range of rotation "C" extends 360° about the first axis "A". As such, the body member 22 is capable of 360° rotation about the first axis "A" (see FIG. 8). In positions of the body member 22 outside the first selected range of rotation "B" the playing pieces 32 will not be retained by the retention means 38, with the result that the pieces will fall from the body member 22.

The inclusion of this feature is advantageous, as it provides additional variety and interest in play, but is not strictly required.

Figure 6:
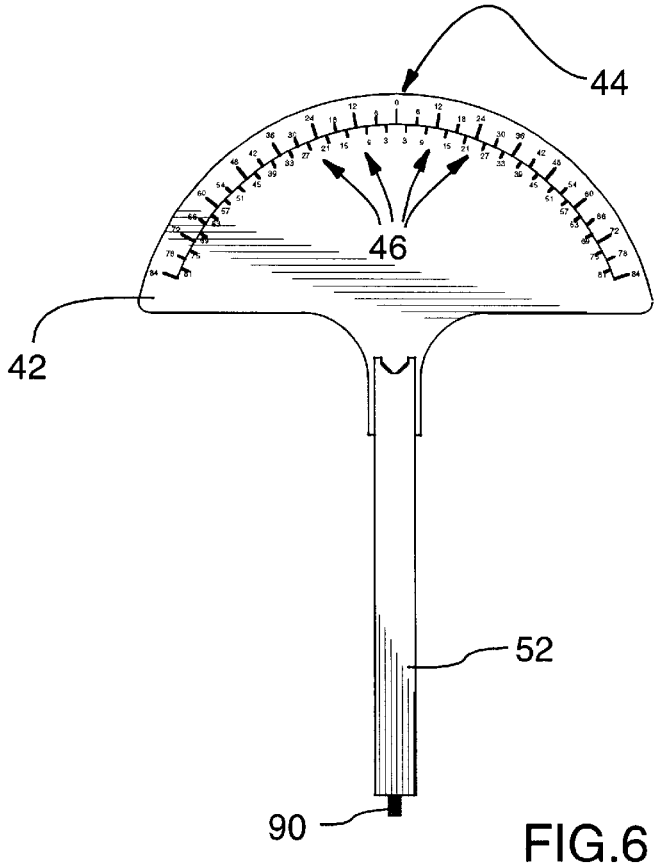
FIG. 6 is a side elevational view of a respective one of the upright members, and the arcuate scale member attached thereto, of the game apparatus of FIG. 1.

Measurement means, designated by general reference numeral 40, are also provided for measuring said variable pivotal displacement. As best seen in FIGS. 1 and 6, the measurement means 40 comprises an arcuate scale member 42 rigidly mounted to the support means 28 and having demarcated thereon an origin 44 and incremental numerical markings 46 extending in both arcuate directions from said origin 44, and a needle member 48 rigidly extending from said body member 22 and pointing toward said origin 44 when the body member 22 is at the starting position thereof.

As seen in FIG. 4, the support means 28 preferably comprises a substantially horizontal base 50 and a pair of substantially vertical upright members 52. The pair of upright members 52 are positioned, respectively, about the body member 25 22, as shown, each being rigidly attached to the base 50 and substantially intersecting the first axis "A", as best seen in FIG. 1. The upright members 52 are attached to the base 50 by way of downwardly extended threaded rod portions 90, which portions 90 are seated in threaded receptacles 92 provided in the base 50, as best seen in FIGS. 4 and 6. Each of the pair of upright members 52 includes a respective upwardly-opening notch portion 62. The body member 22 is provided with a pair of cylindrical boss portions 54 extending outwardly in opposed relation from the peripheral edge 60 of said body member 22 in axially aligned relation with the first axis "A", each of said pair of cylindrical boss portions 54 being journaled for rotation about the first axis "A" within a respective notch portion 62. The cylindrical boss portions 54 are press-fit within respective bushings 58 provided in the body member 22, so as to form opposed stub axles for journaled rotation within the upwardly-opening notch portions 62,62.

The body member 22 preferably further comprises a second axis "D", substantially normal to said first axis "A" and horizontal when said body member 22 is at the starting position thereof. In this manner, the support means 28 is further adapted for the support of the body member 22 in an alternate starting position thereof, indicated in FIG. 11, whereat the second axis "D" is substantially horizontal, the non-planar playing surface 24 presents substantially upwardly and the center of gravity 30 of said body member 22 is positioned substantially below said second axis "D", and for enabling said body member 22 to rotate freely about said second axis "D". The inclusion of these alternate axes "A" and "D" allows for greater variety in play than would result from the inclusion of only a single rotational axis.

As illustrated in FIG. 1, the non-planar playing surface 24 has defined thereon a first playing portion 64 and a second playing portion 66, with the two portions 64, 66 meeting centrally along as "S" shaped line of demarcation 63. When the body member 22 is at the starting position thereof, the first playing portion 64 lies in planes disposed substantially above the first axis "A" and the second playing portion 66 lies substantially in planes disposed beneath the first axis "A" (see FIG. 8). The non-planar playing surface 24 is preferably shaped in the form of the Yin-Yang symbol, with the first playing portion 64 taking the shape of the Yang symbol (hereinafter referred to in this description as "the Yang portion")and the second playing portion 66 taking the shape of the Yin symbol (hereinafter referred to in this description as "the Yin portion". The Yin portion 66 and Yang portion 64 are preferably of contrasting colour, are of substantially equal area, and are substantially disposed on opposite sides of the first axis "A".

Figure 7:
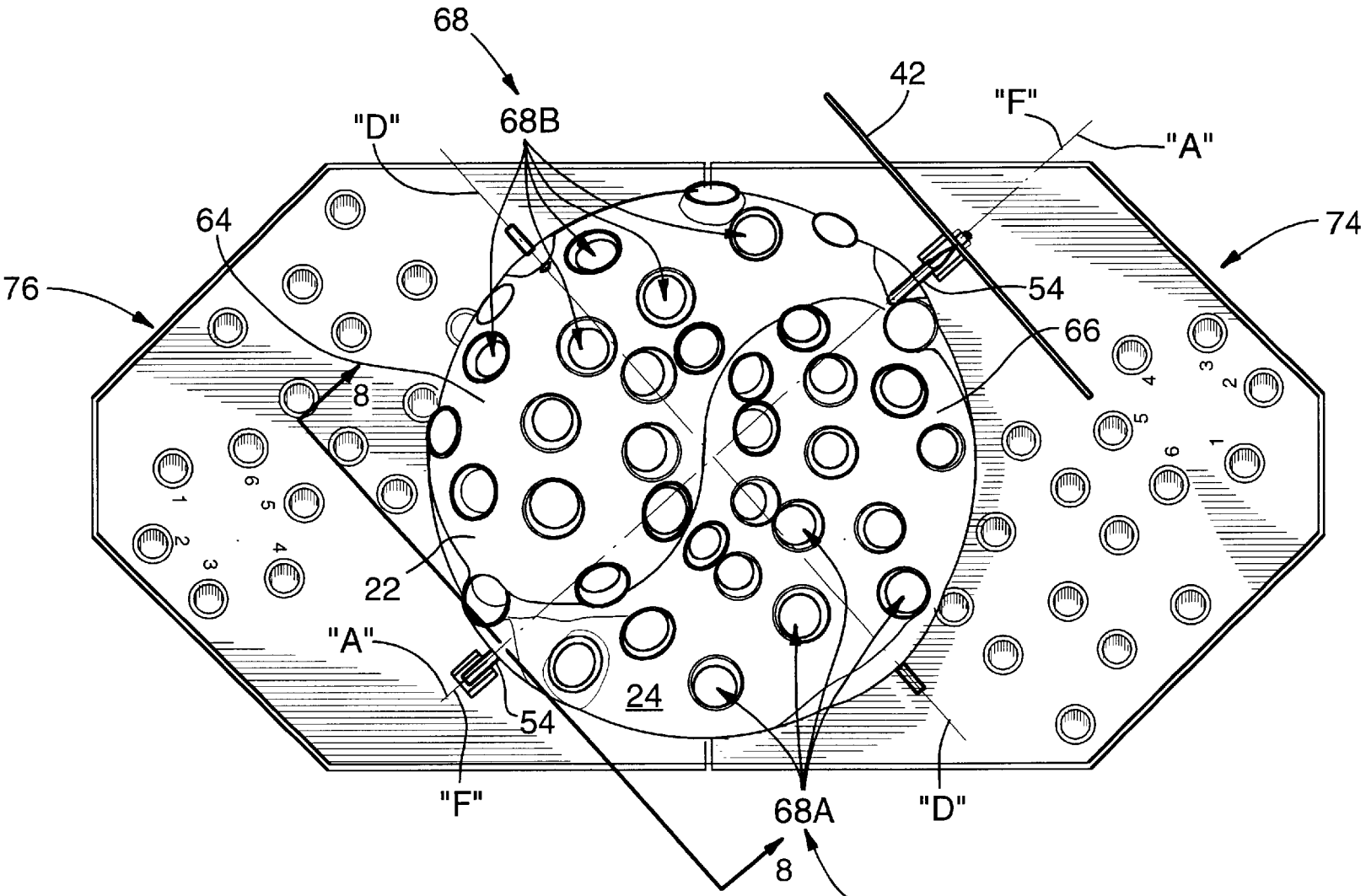
FIG. 7 is a top plan view of the game apparatus of FIG. 1.

The retention means 38 preferably comprises a plurality of sockets 68 positioned one each at each of said first plurality of demarcated playing positions 26, each of said plurality of sockets 68 opening substantially upwardly when said body member 22 is at the starting position thereof, as shown in FIG. 1, and being shaped and dimensioned for releasable receipt of a respective one of said second plurality of playing pieces 32. The quantum of said plurality of sockets 68 is, of course, equal to the quantum of the plurality of demarcated playing positions 26. FIG. 2 shows a respective one of the Yin stones 34 positioned above a respective one of the Yin sockets 68A, for subsequent placement therewithin, such placement being indicated by the arrow 35. As illustrated in FIG. 7, the third plurality of sockets 68 comprises eighteen Yin sockets 68A provided on the Yin portion 66 of the non-planar playing surface 24, and eighteen Yang sockets 68B provided on the Yang portion 64 of the non-planar playing surface 24. Each Yang socket 68B corresponds with a respective one of the Yin sockets 68A and when the body member 22 is at its starting position, it is disposed, with relation to a horizontal plane "E" (see FIG. 8) and with relation to a vertical plane "F" in intersecting relation to the first axis "A", in substantially transverse symmetrical relation thereto. The horizontal plane "E" and vertical plane "F" are illustrated in FIGS. 7 and 8. As best seen in FIG. 1, the first axis "A" lies substantially intermediate the Yin portion 66 and Yang portion 64. The second axis "D" substantially bisects each of the Yin portion 66 and the Yang portion 64.

Figure 12:
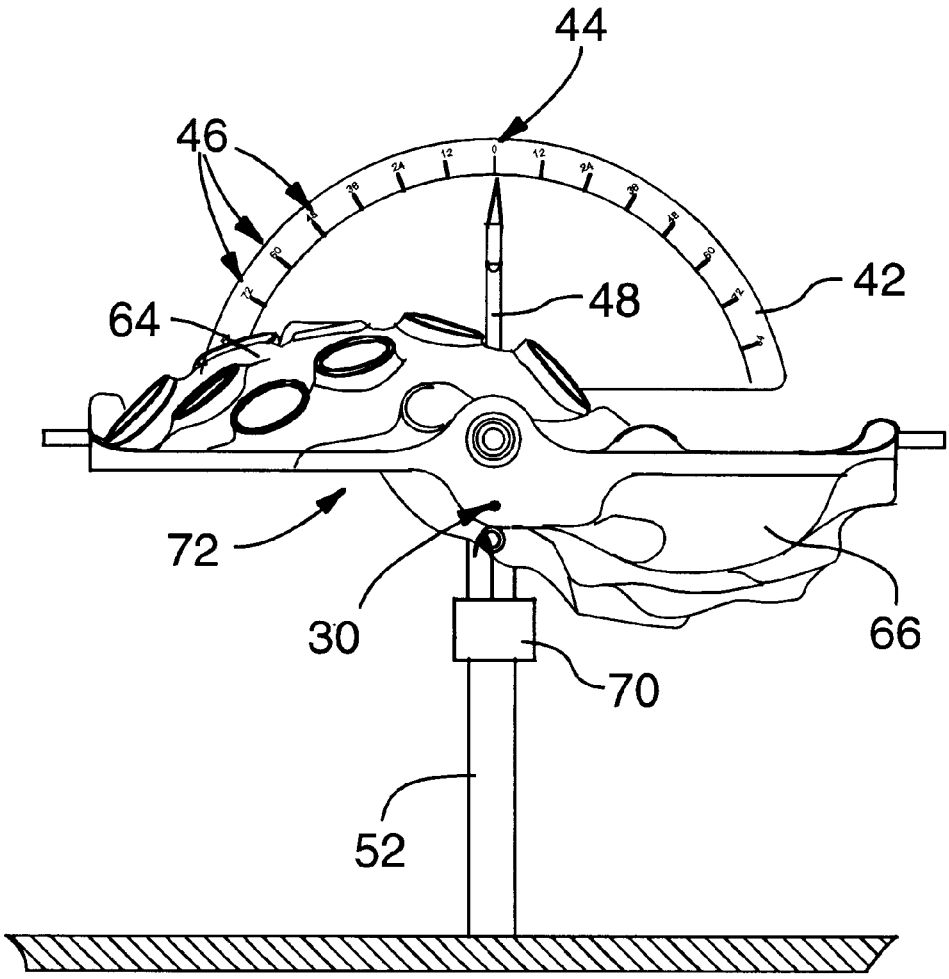
FIG. 12 is a view similar to FIG. 8, showing a counterweight releasably attached to the underside of the body member.

A plurality of counterweights 70 are also provided and are adapted for selective, releasable attachment, singly or in combination, to an underside 72 of the body member 22, as illustrated in FIG. 12. The provision of counterweights 70 allows for the level of difficulty of games played with the game apparatus 20 to be readily adjusted.

Figure 5:
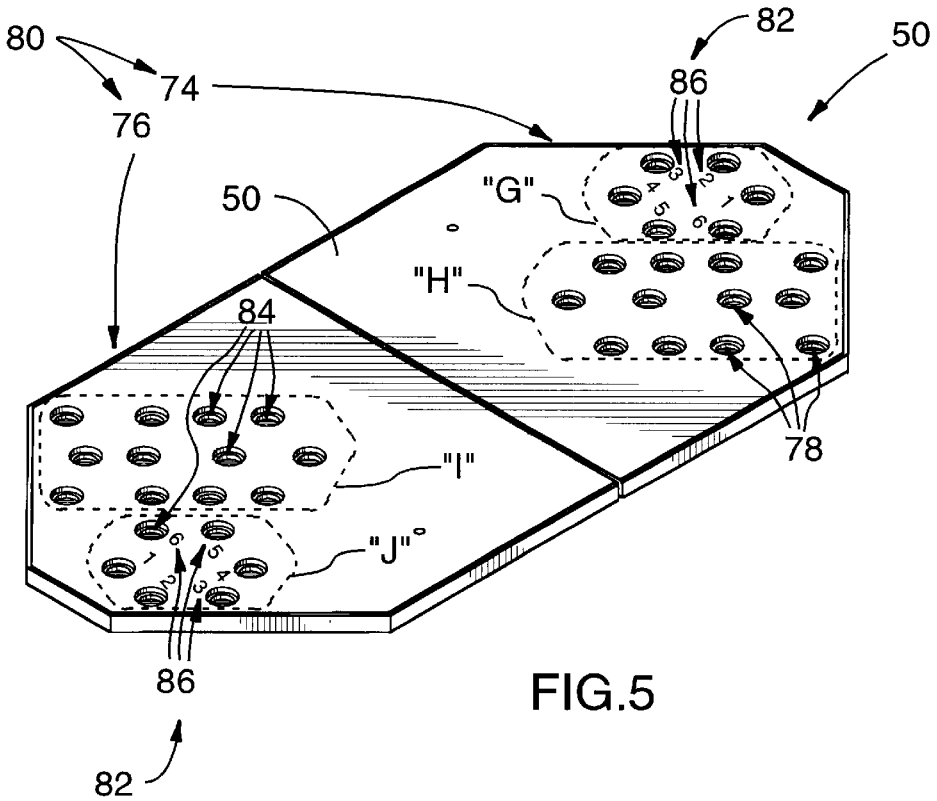
FIG. 5 is a perspective view of the base portion of the game apparatus of FIG. 1.

The base 50 includes a containment means, designated by general reference numeral 80 in FIG. 5, for releasable containment of the second plurality of playing pieces 32. The containment means 80 comprises a Yin tray 74 adapted to contain the Yin stones 34 when not in play. As best seen in FIG. 5, the Yin tray 74 contains eighteen Yin cavities 78, each being adapted to selectively receive a respective one of the Yin stones 34 and collectively arranged in a first grouping of six and a second grouping of twelve, said first grouping and said second grouping being respectively indicated by circumscribed areas "G" and "H" in FIG. 5.

Visual indicia is preferably marked on the upper surface of the base 50. Such visual indicia is denoted by the general reference numeral 82 in FIG. 5. The purpose of such visual indicia 82 is to provide an individual designation for each of the six Yin cavities 78 which comprise the first grouping "G". The visual indicia 82 comprises a series of numerical markings 86 on the base 50, ranging from, for example, 1–6, adjacent each one of the six Yin cavities 78.

The containment means 80 further comprises a Yang tray 76, for releasable containment of the Yang stones 36. The Yang tray 76 similarly contains eighteen Yang cavities 84, each being adapted to selectively receive a respective one of the Yang stones 36 and collectively arranged in a first grouping of six and a second grouping of twelve, said first grouping and said second grouping being indicated, respectively, by circumscribed areas "J" and "I" in FIG. 5.

The visual indicia 82 further provides for an individual designation for each of the six Yang cavities 84 which comprise the first grouping "J" of Yang cavities 84. The indicia 82 comprises a series of numerical markings 86 on the upper surface of the base 50, ranging, for example, from 1–6 and respectively located adjacent each one of the six Yang cavities 84.

A selection means is also preferably provided, designated by the general reference numeral 94, which is seen in FIG. 1 to comprise a conventional die, numbered 1–6, the purpose of which will be more evident upon consideration of the following description of a preferred exemplary method of play.

To commence play, the main body member 22 is positioned at either its starting position or its alternate starting position, by agreement of the players, being Player A and Player B.

The order of play is determined by Player A placing behind his or her back a Yin stone 34 and a Yang stone 36, one in each hand. Player B chooses one of the hands of Player A. If the hand so chosen contains a Yin stone 34, Player B is YIN and Player A is YANG; if the hand chosen contains a Yang stone 36, Player B is YANG and Player A is YIN.

YANG randomly arranges the Yin mystery stones 34E within the first grouping "G" of Yin cavities 78 in the Yin tray 74, and YIN randomly arranges the Yang mystery stones 36E within the first grouping "J" of Yang cavities 84 in the Yang tray 76. The balance of the Yin stones 34 are positioned within the second grouping "H" of Yin cavities 78 in the Yin tray 74 and the balance of the Yang stones 36 are positioned within the second grouping "I" of Yang cavities 84 in the Yang tray 76.

The game is played in four sessions, which are termed "seasons", namely, "spring", "summer", "autumn" and "winter".

Spring is the season for sowing, and the spring season commences with YANG rolling die 94, and playing the respective one of the Yang mystery stones 36E which is positioned in the respective one of the Yang cavities 84 in the first grouping "J" i in the Yang tray 76 which is designated with a number corresponding to the number indicated by the die 94, such play being effected by the placement of said respective one of the mystery stones 36E into any one of the Yang sockets 68B. This results in a pivotal displacement of the body member 22 relative to its starting position, with the effect that the needle 48 is directed towards a respective one of the markings 46, which becomes the score of YANG, which is recorded, on paper or the like. Thereafter, YIN throws the die 94, and plays the respective one of the Yin mystery stones 34E in the respective one of the Yin cavities 78 in the first grouping "G" in the Yin tray 74 which is designated with the number corresponding to the number indicated by the die 94, by placing same into any one of the Yin sockets 68A and recording the resultant score. The die 94 is no longer used in the game. Thereafter, YANG and YIN take turns, each playing a further five of the pieces 32 in their respective trays 76, 74 in the manner previously discussed, provided that at least one of said further five pieces 32 must be a mystery stone 36E, 34E.

At the end of spring, six Yang stones 36 are positioned within the Yang sockets 68B, and six Yin stones 34 are positioned within the Yin sockets 68A.

Summer is the season for growing. Play in summer commences with YANG playing a Yang stone 36 either from the Yang tray 76, or from the Yang sockets 68B, play being effected by the placement of same into a respective one of the Yin sockets 68A and the recordation of the resultant score. Thereafter, YIN plays a Yin stone 34 either from the Yin tray 74 or from the Yin sockets 68A, play being effected by the placement of same into a respective one of the Yang sockets 68B and the recordation of the resultant score. Thereafter, YANG and YIN take turns, each playing a further eleven stones 36,34 in the manner previously discussed, provided that at least two of the twelve stones 34 played by YIN in summer must be mystery stones 34E from the Yin tray 74 (unless less than two mystery stones 34E remain in the Yin tray 74 at the conclusion of spring, whereupon all those remaining, if any, must be played), and at least two of the twelve stones 36 played by YANG in summer must be mystery stones 36E from the Yang tray 76 (unless less than two mystery stones 36E remain in the Yang tray 76 at the conclusion of spring, whereupon all those remaining, if any, must be played).

At the end of summer, twelve Yang stones 36 are positioned within the Yin sockets 68A, and twelve Yin stones 34 are positioned within the Yang sockets 68B.

Autumn is the season for harvest. Play in autumn commences with YANG playing a Yang stone 36 either from the Yang tray 76 or from the Yin sockets 68A, play being effected by the placement of same into a respective one of the Yang sockets 68B and the recordation of the resultant score in the manner previously discussed. Thereafter, YIN plays a Yin stone 34 either from the Yin tray 74 or from the Yang sockets 68B, play being effected by the placement of same into a respective one of the Yin sockets 68A and the recordation of the resultant score. Thereafter, YANG and YIN take turns, each playing a further seventeen stones 36,34 in the manner previously discussed provided that following each of YIN's turns, at least one Yang socket 68B must be available for the subsequent turn of YANG, and following each of YANG's turns, at least one Yin socket 68A must be available for the subsequent turn of YIN.

At the end of autumn, eighteen Yang stones 36 are positioned within the Yang sockets 68B, and eighteen Yin stones 34 are positioned within the Yin sockets 68A.

Winter is the season of dying. Play in winter commences with YIN playing a Yin stone 34 from the Yin sockets 68A, play being effected by the placement of same into a respective one of the Yin cavities 78 in the Yin tray 74 and the recordation of the resultant score. Thereafter, YANG plays a Yang stone 36 from the Yang sockets 68B, play being effected by the placement of same into a respective one of the Yang cavities 84 in the Yang tray 76 and the recordation of the resultant score. Thereafter, YANG and YIN take turns, each playing a further seventeen pieces 32, in the manner previously discussed.

At the end of winter, all of the Yin stones 34 are positioned within the Yin tray 74, and all of the Yang stones 36 are positioned with the Yang tray 76.

Thus, the game is completed, and the total scores of each players are tallied; the player with the lowest score wins.

While but a single preferred embodiment of the present invention is herein shown and described, it will be understood that the spirit and scope of the invention is limited only by the accompanying claims, such that various modifications and alterations may be used in the design and manufacture of the game apparatus according to the present invention, without departing from its spirit or scope. For example, in a first alternative embodiment of the present invention, not shown, the game board could be substantially planar. However, this would detract from the interest of the game, and as such, is not preferred. Similarly, the respective masses of the playing pieces could be altered, as could the frictional interaction between the playing pieces and the sockets, to simplify or complicate the game, dependent upon the skill level of the players. Similarly, while but a single method of play has been outlined, it will be evident that a wide variety of methods of play may be utilized.

I claim:

1. A game apparatus comprising:

a body member having a first axis, a non-planar playing surface and a continuous peripheral edge; and a support means for supporting said body member in a starting position thereof, whereat said first axis is substantially horizontal and said non-planar playing surface presents substantially upwardly, and for enabling said body member to rotate freely about said first axis;

said body member being weighted, shaped and dimensioned such that, when said body member is at the starting position thereof, a center of gravity of said body member is positioned substantially below said first axis.

2. A game apparatus according to claim 1, wherein the non-planar playing surface has defined thereon a first plurality of demarcated playing positions.

3. A game apparatus according to claim 2, further comprising a second plurality of playing pieces.

4. A game apparatus according to claim 3, wherein the first plurality of demarcated playing positions is equivalent in number to the second plurality of playing pieces.

5. A game apparatus according to claim 3, wherein the support means enables said body member to rotate freely about said first axis through a first selected range of rotation.

6. A game apparatus according to claim 5, further comprising a retention means for retaining selected ones of said second plurality of playing pieces in fixed position relative to said non-planar playing surface upon selective distribution of said selected ones of said second plurality of playing pieces at respective ones of said first plurality of demarcated playing positions.

7. A game apparatus according to claim 6, wherein the body member is further adapted for variable pivotal displacement about said first axis relative to said starting position by effect of gravity responsive to said selective distribution of said selected ones of said second plurality of playing pieces at said respective ones of said first plurality of demarcated playing positions.

8. A game apparatus according to claim 7, further comprising a measurement means for measuring said variable pivotal displacement.

9. A game apparatus according to claim 8, wherein the support means enables said body member to rotate freely about said first axis through a second selected range of rotation containing the first selected range of rotation; and wherein the retention means retains said selected ones of said second plurality of playing pieces in fixed position relative to said non-planar playing surface upon said selective distribution of said selected ones of said second plurality of playing pieces at said respective ones of said first plurality of demarcated playing positions when said body member is positioned within the first selected range of rotation.

10. A game apparatus according to claim 9, wherein the retention means comprises a plurality of sockets positioned one each at each of said first plurality of demarcated playing positions, each of said plurality of sockets opening substantially upwardly when said body member is at the starting position thereof and being shaped and dimensioned for upwardly releasable receipt of a respective one of said second plurality of playing pieces.

11. A game apparatus according to claim 8, wherein the measurement means comprises:

an arcuate scale member rigidly mounted to the support means and having demarcated thereon an origin and incremental numerical markings extending in both arcuate directions from said origin; and a needle member rigidly extending from said body member and pointing toward said origin when the body member is at the starting position thereof.

12. A game apparatus according to claim 3, wherein the second plurality of playing pieces are of varied mass.

13. A game apparatus according to claim 3, wherein the support means comprises a substantially horizontal base and a pair of substantially vertical upright members, said pair of upright members being positioned, respectively, about the body member and each being rigidly attached to the base and intersecting the first axis.

14. A game apparatus according to claim 13, wherein the base includes a containment means for releasable containment of the second plurality of playing pieces.

15. A game apparatus according to claim 14, wherein the containment means comprises a first grouping of six cavities, each adapted to receive a respective one of the second plurality of playing pieces.

16. A game apparatus according to claim 15, further comprising visual indicia providing an individual designation for each of the cavities which comprise the first grouping of six cavities.

17. A game apparatus according to claim 16, wherein the visual indicia comprises a series of respective numerical markings on the base adjacent each of the six cavities which comprise the first grouping.

18. A game apparatus according to claim 17, further comprising a selection means for randomly selecting a respective one of the six cavities by way of reference to said visual indicia.

19. A game apparatus according to claim 18, wherein the selection means is a die.

20. A game apparatus according to claim 1, wherein the support means comprises a substantially horizontal base and a pair of substantially vertical upright members, said pair of upright members being positioned, respectively, about the body member and each being rigidly attached to the base and intersecting the first axis.

21. A game apparatus according to claim 20, wherein each of said pair of upright members includes a respective upwardly-opening notch portion.

22. A game apparatus according to claim 21, wherein the body member further comprises a pair of cylindrical boss portions each extending outwardly in opposed relation from the peripheral edge of said body member in axially aligned relation with the first axis, with each of said pair of boss portions being journaled within a respective one of said upwardly-opening notch portions for rotation of the body member about the first axis.

23. A game apparatus according to claim 1, wherein the non-planar playing surface has defined thereon a first playing portion and a second playing portion.

24. A game apparatus according to claim 23, wherein, when the body member is at the starting position thereof, the first playing portion lies substantially above the first axis and the second playing portion lies substantially beneath the first axis.

25. A game apparatus according to claim 1, wherein said body member has a second horizontal axis disposed substantially normal to said first axis when said body member is at the starting position thereof.

26. A game apparatus according to claim 25, wherein the support means is further adapted for the support of the body member in an alternate starting position thereof, whereat the non-planar playing surface presents substantially upwardly and the center of gravity is positioned substantially below the second axis, and for enabling said body member to rotate freely about said second axis.

* * * * *